US005651278A

United States Patent [19]

Pinkowski

[11] Patent Number: 5,651,278

[45] Date of Patent: Jul. 29, 1997

[54] AGITATOR WITH ENHANCED CLOTHES ENGAGING VANE FOR AUTOMATIC WASHER

[75] Inventor: Robert J. Pinkowski, Baroda Township, Berrien County, Mich.

[73] Assignee: Whirlpool Corporation, Benton Harbor, Mich.

[21] Appl. No.: 114,663

[22] Filed: Aug. 31, 1993

[51] Int. Cl.[6] ..... D06F 13/06

[52] U.S. Cl. ..... 68/134; 68/23.7; 68/133

[58] Field of Search ..... 68/131, 132, 133, 68/134, 28, 38, 53, 54, 89, 184, 23.6, 23.7; 366/243, 247, 314

[56] References Cited

U.S. PATENT DOCUMENTS

| | | | |
|---|---|---|---|
| 1,915,053 | 6/1933 | Dobyns | 366/319 |
| 2,253,989 | 8/1941 | Skinner . | |
| 2,303,979 | 12/1942 | Blake | 68/23.7 X |
| 2,307,458 | 1/1943 | Freitas | 68/134 |
| 2,331,897 | 10/1943 | Dyer | 68/23.7 |
| 2,356,573 | 8/1944 | Dunham . | |
| 2,471,876 | 5/1949 | Kuhn . | |
| 3,211,434 | 10/1965 | Pickles | 68/134 X |
| 3,315,500 | 4/1967 | Brundage et al. | 68/23.7 X |
| 3,726,114 | 4/1973 | Ahmad | 68/134 |
| 3,987,651 | 10/1976 | Platt . | |
| 4,338,802 | 7/1982 | Ohmann et al. | 68/134 X |
| 4,391,107 | 7/1983 | Gibson | 68/133 |
| 4,693,095 | 9/1987 | Burk et al. | 68/134 |
| 4,858,450 | 8/1989 | Noh . | |
| 4,912,947 | 4/1990 | Dai . | |

FOREIGN PATENT DOCUMENTS

| | | | |
|---|---|---|---|
| 275342 | 6/1914 | Germany | 68/23.7 |
| 54-137863 | 10/1979 | Japan | 68/23.7 |
| 64-64689 | 3/1989 | Japan | 68/23.6 |
| 2-249586 | 10/1990 | Japan | 68/134 |

*Primary Examiner*—Frankie L. Stinson
*Attorney, Agent, or Firm*—Hill, Steadman & Simpson

[57] ABSTRACT

An improved agitator construction is provided for an automatic clothes washing machine in which a surface or contour of a vane carried on a portion of the agitator which is intermittently rotated in a single direction is shaped to enhance engagement between the vane and the items being washed and to retard the items from moving at least one of radially and upwardly relative to the agitator. The vane, which may be a helical vane, may be provided with a lower surface angled downwardly and outwardly in a radial direction, or may be provided with one or more steps having a relatively steep sloped wall facing in a direction leading away from the direction of rotation of the agitator and a relatively shallow sloped wall facing in a direction leading toward the direction of rotation of the agitator, or both shapes.

20 Claims, 3 Drawing Sheets

AGITATOR WITH ENHANCED CLOTHES ENGAGING VANE FOR AUTOMATIC WASHER

BACKGROUND OF THE INVENTION

This invention relates to an agitator for a vertical axis automatic washing machine in which the agitator oscillates to provide a tumbling or rollover motion to the clothes or other articles contained within the machine.

Many types and constructions of agitators are well known in the art including a combined oscillating and unidirectional agitator such as that disclosed in U.S. Pat. No. 3,987,651, assigned to the assignee of the present application, the disclosure of which is incorporated herein by reference.

That patent discloses an agitator having a lower agitator element driven in an oscillatory manner and an upper agitator element mounted coaxially with the lower agitator element and driven rotationally in one direction only. Means, such as a helical vane, are provided with the upper agitator element for imparting a downward motion to the items to be washed. The helical vane presents a continuous ramp surface facing the direction of rotation such that clothing items which strike the vane will be continuously urged downwardly toward the lower agitator element. The patent also discloses that a plurality of such helical vanes may be provided on the upper agitator element.

SUMMARY OF THE INVENTION

The present invention provides an improved agitator construction which combines a lower oscillating agitator element with a unidirectional rotating upper agitator element. Means, which again may be in the form of a helical vane, are provided on the upper agitator element to engage the clothes or other items to be washed as the upper agitator element rotates. The vanes of the upper agitator element, however, are shaped in such a manner so as to retard the items from moving away from the vane as it rotates or relative to the vane in an upwardly manner. Thus, the vane can have a contour, preferably on its lower surface, which is shaped to enhance engagement between the items and the vane. In this manner, the items are caused to move downwardly along the agitator as the agitator is rotationally driven.

In a first embodiment of the invention, the vane is illustrated in the form a helical vane in which the lower surface of the vane extends downwardly and outwardly in a radial direction from the agitator. In this manner the vane has an undercut appearance which helps to retard the items from moving radially outwardly with respect to the vane as the agitator rotates. That is, the items are prevented from sliding radially outwardly off of the vane since the vane is tipped downwardly from horizontal. As the agitator rotates the downward spiral of the vane urges the items downwardly and since the items remain "capture" or engaged by the vane, they move downwardly rapidly.

In a second embodiment of the invention a helical vane is again illustrated in which a lower surface of the vane is provided with a plurality of wedge shaped steps. The steps have a substantially vertical wall on a side leading away from the direction of rotation and a ramp wall on a side leading toward the direction of rotation. Thus, as the upper agitator element is rotated, the ramp walls will permit the items to be urged downwardly by the vane and when the rotation of the agitator stops, the short vertical wedge walls will engage the items and retard them from moving upwardly along an underside of the helical vane. In this manner, the items will be caused to move downwardly along the agitator more quickly.

DETAILED DESCRIPTION OF THE PREFERRED EMBODIMENTS

Figure 1:
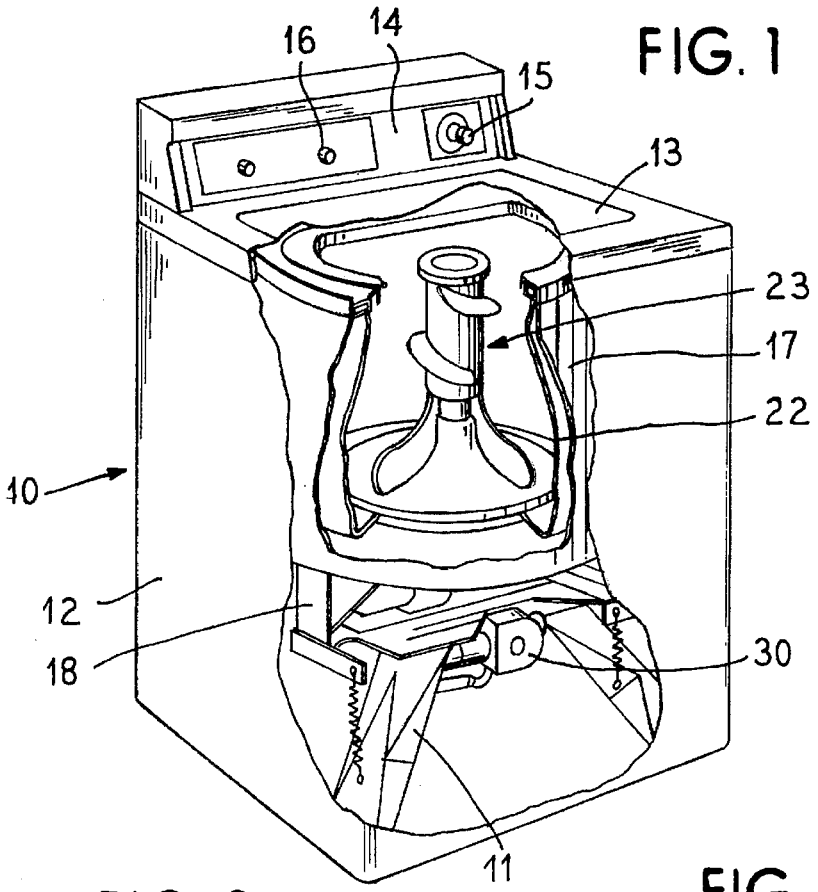
FIG. 1 is a view, partially broken away, of a conventional automatic washing machine assembly provided with an improved agitator means according to the present invention.
Figure 3:
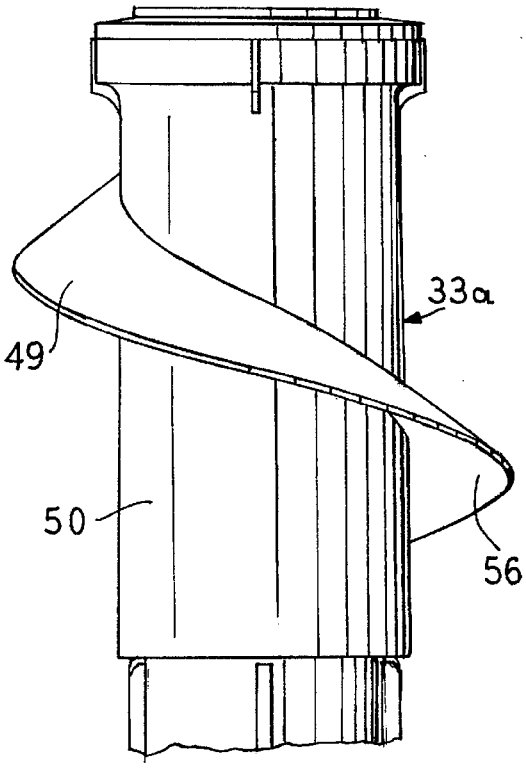
FIG. 3 is a side elevational view of an upper portion of the agitator means of FIG. 1.
Figure 4:
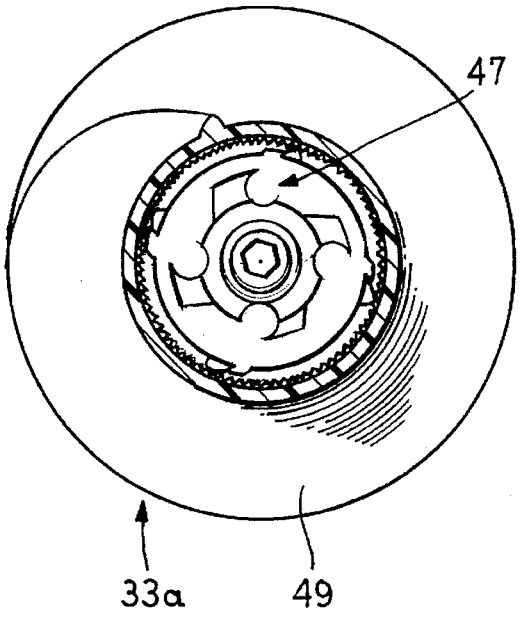
FIG. 4 is a top view of the upper portion of FIG. 3 with a top cap removed.

In FIG. 1, an automatic washing machine is shown generally at 10 including a frame 11 carrying vertical panels 12 forming the sides, front and back of the machine. A hinged lid 13 is provided in the usual manner to provide access to the interior of the washing machine. The washing machine 10 has the usual console 14 including a timer dial 15 and a program selector 16. Electronic controls can be utilized as known in the art.

Internally of the machine there is situated an imperforate tub 17 which is supported within the cabinet by means of a support member 18. A perforate washing receptacle or basket 22 is positioned concentrically within the tub 17. Centrally of the perforate washing basket 22 is an improved agitator means which has been designated generally in the drawings at reference numeral 23. As is known, liquid may be introduced into the washing machine by means of a solenoid controlled inlet valve which directs the liquid through a conduit and through an anti-syphon device into the washing area.

A motor 30 operates through a transmission. A clutch and brake assembly is provided for energizing the agitator means 23 during washing, and for disengaging the agitator and engaging a spin tube for spinning the basket 22 during the liquid extraction portion of the washing phase. All of the drive elements and hydraulic units described thus far are conventional and vertical axis automatic washing machines, and the improvements of the present invention are centered in the agitator means 23, which is described specifically below.

Figure 2:
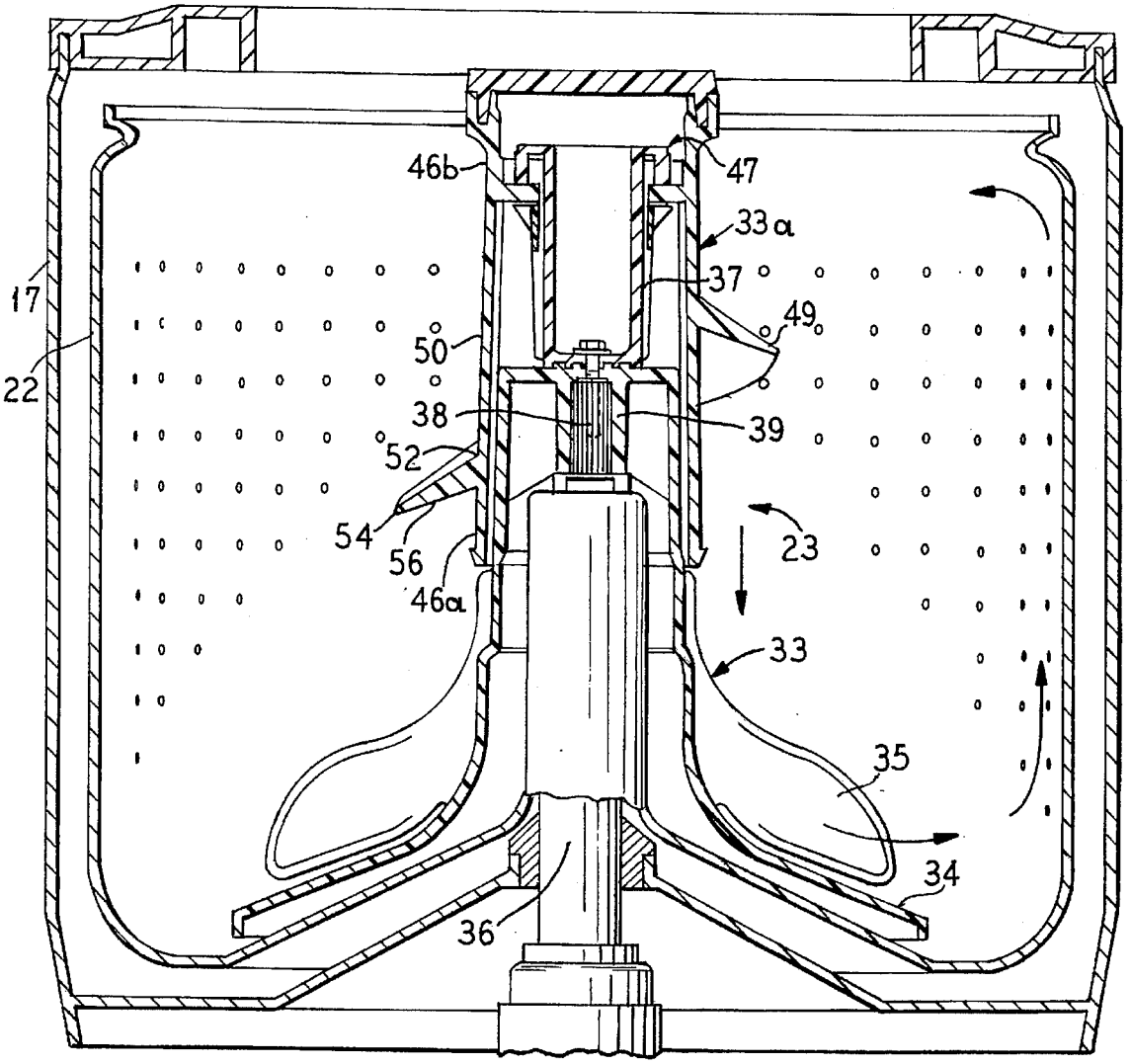
FIG. 2 is a vertical cross sectional view of the improved agitator means of the present invention.
Figure 5:
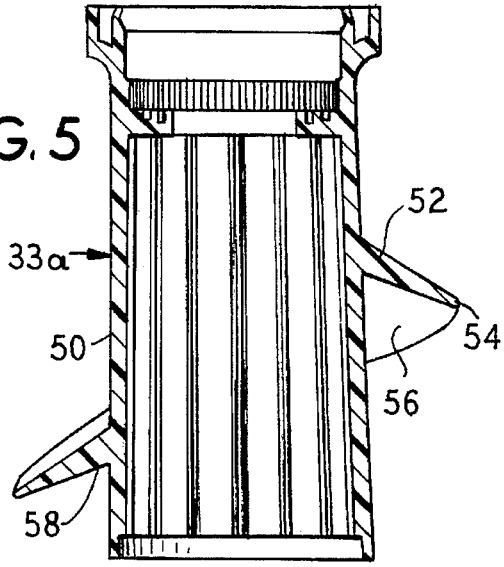
FIG. 5 is a side cross sectional view of the upper portion of FIG. 3.
Figure 6:
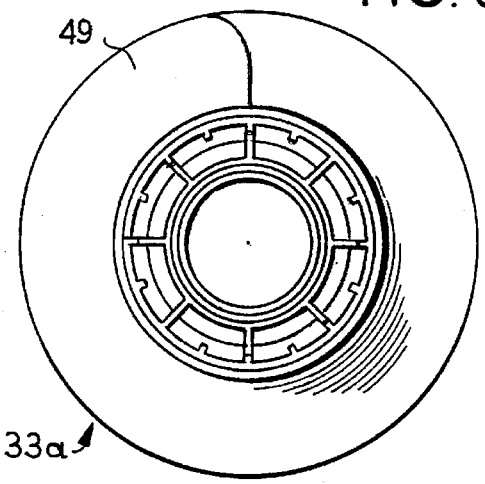
FIG. 6 is a bottom elevational view of the upper portion of FIG. 3.
Figure 7:
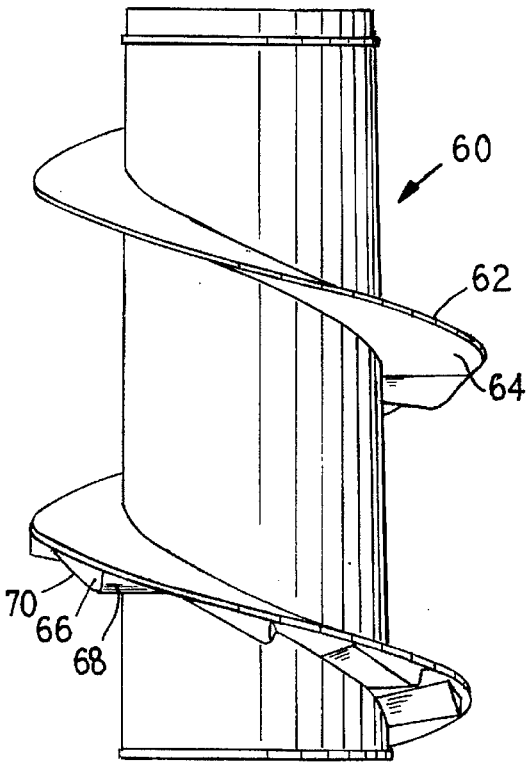
FIG. 7 is a side elevational view of a second embodiment of an upper portion of an agitator means according to the present invention.
Figure 8:
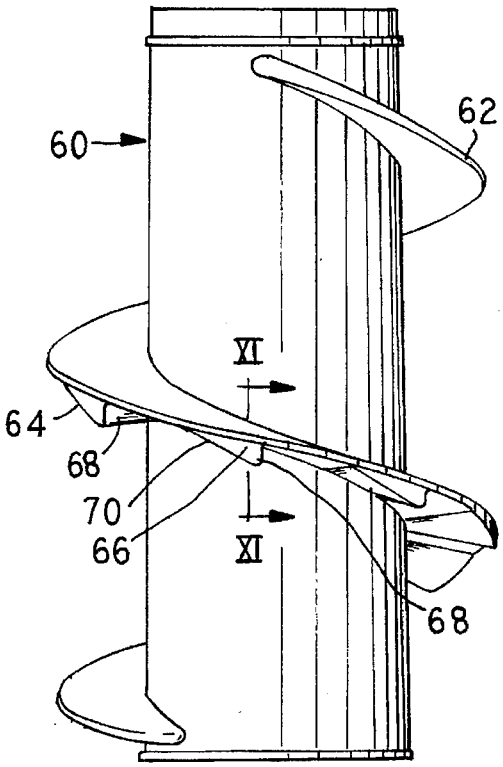
FIG. 8 is a side elevational view of the upper portion of FIG. 1, rotated 90° about a vertical axis.
Figure 10:
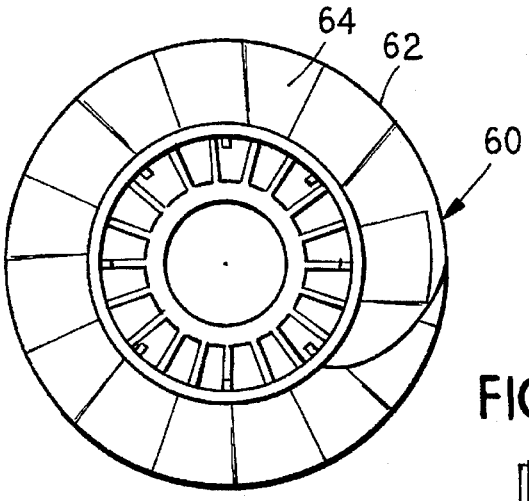
FIG. 10 is a bottom elevational view of the upper portion of FIG. 7.
Figure 9:
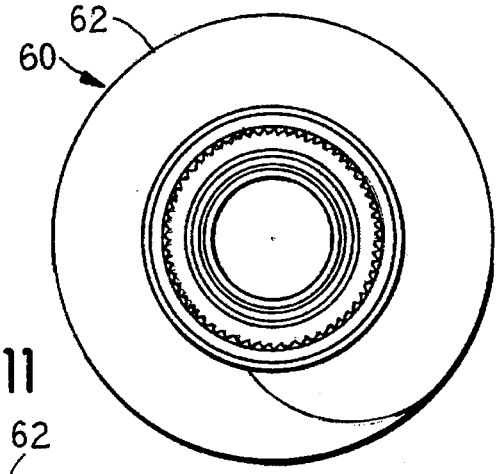
FIG. 9 is a top view of the upper portion of FIG. 7.
Figure 11:
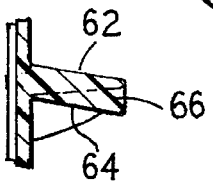
FIG. 11 is a side sectional view taken generally along line XI—XI of FIG. 8.

As seen in FIG. 2, the agitator means 23 has a lower agitator element 33 with a skirt portion 34 which carries a plurality of spaced, generally vertical agitator vanes 35. An agitator drive shaft 36 extends through the lower agitator element 33 and a portion of an upper agitator element **33*a*** and is secured to a cam mounting cylinder 37. The shaft 36 has a splined portion 38 which is rigidly connected to an agitator drive coupler 39 for oscillating the lower agitator element 33 in the usual manner.

The upper agitator element 33*a* is composed of a plastic material and, as illustrated in FIGS. 2–6, is hollow and has a larger diameter end portion 46*a* in the area adjacent to the lower agitator element 33, and a smaller-diameter upper portion 46*b* at the upper end thereof. As best illustrated in FIG. 2, the lower end of the upper agitator element 33*a* is received in overlapping relationship with the upper portion of the lower agitator element 33. The agitator drive shaft 36 extends up through the upper agitator element 33*a* and is mechanically coupled thereto through a one-way drive mechanism such as a one-way clutch 47. An exemplary clutch is disclosed in U.S. Pat. No. 4,719,769, assigned to the assignee of the present invention, the disclosure of which is incorporated herein by reference.

The outer periphery of the upper agitator element 33*a* is provided with vane means 49 for urging clothes downwardly. A continuous helical vane 49 coaxial with the axis of rotation of the lower agitator element 33 is shown extending outwardly from the cylindrical wall of the upper agitator element 33*a* down the length of the upper agitator element 33*a* and terminating short of the vertical agitator vanes 35 for urging or deflecting clothes downwardly.

The vane means 49 attaches to a barrel portion 50 of the agitator at a root end 52 and, as seen in cross section, extends downwardly and outwardly to a tip 54. Thus, a bottom surface 56 of the vane is shaped so as to provide an undercut or recessed space 58 between the tip of the vane 54 and the agitator barrel 50. As items to be washed are engaged by the vane means 49, this undercut shape of the lower surface 56 will retard the items from moving radially outwardly relative to the vane means 49 and will enhance engagement between the items and the vane causing the items to be move downwardly as the vane is rotationally driven and to prevent the items from moving away from the agitator either as it moves or when it is at rest.

With the arrangement shown in FIGS. 2–6, the upper agitator element 33*a* is positively driven through the one-way clutch 47 only when the agitator drive shaft 36 is moved in a counter clockwise direction. Under a full clothes load, when the agitator drive shaft 36 moves in a clockwise direction, the one-way clutch 47 allows the upper agitator element to remain relatively stationary due to the frictional drag placed thereon by the water and the clothes within the basket.

Thus, there is a substantially automatic sensing of the magnitude of the clothes load to provide incremental rotation under significant clothes load conditions. This incremental or intermittent rotation of the upper agitator element 33*a* with a large clothes load provides a double action and causes the helical vane 49 to act as an auger and thus auger or urge the clothes downwardly along the upper agitator element into the oscillating vertical agitator vanes 35 which move the clothes radially outwardly toward the periphery of the basket 22, then upwardly and inwardly toward the upper agitator element 33*a*, all is indicated by the arrows shown in FIG. 2 of the drawings. This creates a highly desireable generally toroidal rollover movement or action which subjects the clothes to intimate contact with the washing liquid and to effective scrubbing action from the lower agitator element.

Applicants have conducted tests on a vane having this construction to determine the frequency of rollover of clothing articles placed within the wash basket during a wash cycle and have compared the results to a test utilizing an agitator construction such as that disclosed in U.S. Pat. No. 3,987,651 where the vanes project horizontally, and have found that the vane construction disclosed herein provides a greatly enhanced rollover rate with the improved ratio increasing as the size of the clothes load being washed increases up to at least a 100% increase. Thus, since washability is improved by increasing the rollover rate, this invention permits an enlarged clothes load to be washed in a washer having similar basket size and agitator constructions and would allow for a shorter wash cycle in order to result in a similar level of dirt removal as is provided in currently available washers.

For example, a washer that typically was rated for an 18 pound maximum load could now easily handle a 20 pound load and provide the same or an improved level of washability.

A modified form of an upper agitator element 60 for use in the present invention is illustrated in FIGS. 7–11 of the drawings. These figures illustrate the upper agitator element 60 having a helical vane 62. A lower surface 64 of the vane is contoured so as to have a plurality of wedge shaped steps 66 formed thereon. Each step has a substantially vertical wall 68 on a side leading away from the direction of rotation of the upper agitator element 60 (down the slope of the helical vane 62) and a ramp wall 70 on a side leading toward the direction of rotation. This shape for the lower surface 64 will retard the items being washed from moving upwardly along or with an underside of the helical vane as the vane is rotated. Thus, the items will be caused to move downwardly by the vane as it is rotationally driven and the items will be prevented from moving upwardly relative to the agitator and vane when the agitator is stationary.

This arrangement has also been tested and has been found to increase the rate of rollover relative to that provided by presently available structure such as that disclosed in U.S. Pat. No. 3,987,651.

Of course, the upper agitator may be provided with both surface contours for the vane, that is, the lower surface of the vane may be sloped downwardly and outwardly and one or more steps may be provided to increase the rate of rollover above that achieved by using only one of the described surface contours.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In an automatic washer having a washing receptacle for containing washing liquid and items to be washed, agitator means within said receptacle for imparting a rollover motion to said items to be washed, and drive means for driving said agitator means, said agitator means comprising:

a lower agitator element driven by the drive means in an oscillatory manner, an upper agitator element mounted above said lower agitator element and co-axial therewith, said upper agitator element being positively rotationally driven by said drive means in one direction only, and a helical vane rigidly affixed to and extending outwardly from a perimeter of said upper agitator element, with a surface configuration of said vane shaped to enhance engagement between said items and said vane, said vane having a smooth and continuous lower surface angled downwardly and outwardly in a radial direction from said upper agitator element such that rotation of said helical vane with said upper agitator element forces said items to be washed in a downward direction along said upper agitator element and retards radial Outward movement of Said items away from said agitator element.

2. In an automatic washer as claimed in claim 1, wherein a lower end of said upper agitator element is received in overlapping relationship with respect to an upper end of said lower agitator element.

3. In an automatic washer having a washing receptacle for containing washing a liquid and items to be washed, agitator means within said receptacle for imparting a rollover motion to said items to be washed, and drive means for driving said agitator means, said agitator means comprising:

lower agitator element driven by the drive means in an oscillitory manner, an upper agitator element mounted above said lower agitator element and co-axial therewith, said upper agitator element being positively rotationally driven by said drive means in one direction only, and a helical vane rigidly affixed to and extending outwardly from a perimeter of said upper agitator element, with a surface configuration of said vane shaped to enhance engagement between said items and said vane such that rotation of said helical vane with said upper agitator element forces said items to be washed in a downward direction along said upper agitator element wherein a lower surface of said vane has at least one wedge shaped step formed thereon, said step having a substantially relatively steep sloped wall on a side leading away from said one direction of rotation and a relatively shallow sloped wall on a side leading toward said one direction of rotation.

4. In an automatic washer as claimed in claim 3, wherein said relatively steep sloped wall is substantially vertical.

5. In an automatic washer as claimed in claim 3, wherein a plurality of steps are provided on said lower surface.

6. An agitator assembly for an automatic clothes washing machine comprising:

a lower agitator element, an upper agitator element positioned above said lower agitator element, drive means for driving said lower agitator element in an oscillatory manner and said upper agitator element in a unidirectional manner, and a helical vane located on an outer portion of said upper agitator element, being shaped to retard said items from moving radially outwardly along an underside of said helical vane, in that said vane has a smooth and continuous lower surface angled downwardly and outwardly in a radial direction from said upper agitator element for urging articles adjacent thereto in a downward direction and retarding radial outward movement of said articles away from said agitator element.

7. An agitator assembly for and automatic washing machine as claimed in claim 6, wherein said lower agitator element includes a lower skirt portion having a plurality of generally vertically disposed vanes extending upwardly and radially outwardly therefrom.

8. An agitator assembly for an automatic clothes washing machine comprising:

a lower agitator element, an upper agitator element positioned above said lower agitator element, drive means for driving said lower agitator element in an oscillatory manner and said upper agitator element in a unidirectional manner, and a helical vane located on an outer portion of said upper agitator element, being shaded to retard said items from moving at least one of radially outwardly and helically upwardly along an underside of said helical vane, for urging articles adjacent thereto in a downward direction, wherein a lower surface of said vane has at least one wedge shaped step formed thereon, said step having a relatively steep sloped wall on a side leading away from said one direction of rotation and a relatively shallow sloped wall on a side leading toward said one direction of rotation.

9. An agitator assembly as claimed in claim 8, wherein said relatively steep sloped wall is substantially vertical.

10. An agitator assembly as claimed in claim 8, wherein a plurality of steps are provided on said lower surface.

11. In a clothes washing machine having a washing receptacle, means for effecting a rollover movement of the clothes in the receptacle during a washing operation, said means comprising:

a double-action agitation means mounted substantially vertically including an oscillating lower element provided with vanes to direct clothes outwardly toward a perimeter of said receptacle, and a unidirectional intermittently rotating upper element having a helical vane for positively urging clothes downwardly to said lower element, said vane having a contour shaped to enhance engagement between said clothes and said vane means, said vane having a smooth and continuous lower contour angled downwardly and outwardly in a radial direction from said upper agitator element such that rotation of said helical vane with said upper agitator element forces said clothes in a downward direction along said upper agitator element and retards radial outward movement of said clothes away from said agitator element, said upper and lower elements interacting to produce said rollover movement of said clothes during the washing operation.

12. In a clothes washing machine having a washing receptacle claimed in claim 11 wherein said vane means associated with the upper element comprises a helical vane rigidly affixed to and extending outwardly from a perimeter of said upper agitator element.

13. In a clothes washing machine as claimed in claim 11, wherein a lower contour of said vane means is angled downwardly and outwardly in a radial direction from said upper agitator element.

14. In a clothes washing machine as claimed in claim 11, wherein lower end of said upper agitator element is received in overlapping relationship with respect to an upper end of said lower agitator element.

15. In a clothes washing machine as claimed in claim 11, wherein said lower agitator element includes a lower skirt portion having a plurality of generally vertically disposed vanes extending upwardly and radially outwardly therefrom.

16. In a clothes washing machine having a washing receptacle, means for effecting a rollover movement of the clothes in the receptacle during a washing operation, said means comprising:

a double-action agitation means mounted substantially vertically including an oscillating lower element provided with vanes to direct clothes outwardly toward a perimeter of said receptacle, and a unidirectional intermittently rotating upper element having vane means for positively urging clothes downwardly to said lower element, said vane means having a contour shaped to enhance engagement between said items and said vane means, said upper and lower elements interacting to produce said rollover movement of said clothes during the washing operation wherein a lower contour of said vane means has at least one wedge shaped step formed thereon, said step having a relatively steep sloped wall on a side leading away from said one direction of rotation and a relatively shallow sloped wall on a side leading toward said one direction of rotation.

17. In a clothes washing machine as claimed in claim 16, wherein said relatively steep sloped wall is substantially vertical.

18. In a clothes washing machine as claimed in claim 16, wherein a plurality of steps are provided on said lower surface.

19. A vertical axis agitator comprising:

a vertical axis tubular barrel portion;

said upper portion having a vane extending radially outward from said barrel portion and extending in a helical direction around said barrel portion;

said vane having an attachment to said barrel portion at a root end thereof and a free distal tip radially spaced from said barrel portion;

said vane having a lower surface which is smooth in said helical direction;

said distal tip being spaced vertically below said root end as measured along a line perpendicular to said barrel portion.

20. In an automatic washer having a washing receptacle for containing washing liquid and items to be washed, an agitator within said receptacle for imparting a rollover motion to said items to be washed, and drive means including a drive shaft for driving said agitator in an oscillatory manner, said agitator comprising:

a lower portion mechanically coupled to said drive shaft for oscillatory movement;

an upper portion with a vertical axis tubular barrel portion;

a one-way clutch mechanism mechanically coupled between said drive shaft and said upper portion to drive said upper portion in intermittent rotary motion;

said upper portion having a vane extending radially outward from said barrel portion and extending in a helical direction around said barrel portion;

said vane having an attachment to said barrel portion at a root end thereof and a free distal tip radially spaced from said barrel portion;

said vane having a lower surface which is smooth in said helical direction;

said distal tip being spaced vertically below said root end as measured along a line perpendicular to said barrel portion.

* * * * *